United States Patent [19]

VanBenthuysen et al.

[11] 4,105,988

[45] Aug. 8, 1978

[54] TANDEM ELECTRICAL CONTROL

[75] Inventors: John D. VanBenthuysen, Elkhart, Ind.; Thomas W. Flanders, Edwardsburg, Mich.; John R. Gietzen, Elkhart, Ind.

[73] Assignee: CTS Corporation, Elkhart, Ind.

[21] Appl. No.: 753,477

[22] Filed: Dec. 22, 1976

[51] Int. Cl.[2] ..... H01C 10/16

[52] U.S. Cl. ..... 338/132; 338/134; 338/171; 338/200

[58] Field of Search ..... 338/132, 134, 166, 162, 338/167, 171, 172, 190, 200

[56] References Cited

U.S. PATENT DOCUMENTS

| | | | |
|---|---|---|---|
| 2,632,830 | 3/1953 | Aust et al. | 338/171 |
| 2,942,221 | 6/1960 | DiGirolamo | 338/200 |
| 3,611,245 | 10/1971 | Puerner | 338/134 |
| 3,913,059 | 10/1975 | Matsui et al. | 338/132 X |

*Primary Examiner*—C. L. Albritton
*Attorney, Agent, or Firm*—John J. Gaydos

[57] ABSTRACT

A tandem electrical control comprises a plurality of variable resistance sections. Each resistance section comprises a resistance element and a collector member that are carried by a base, and a contactor member that is carried by a driver, the contactor member is rotatably supported within the respective housing and wipingly engages the respective resistance element and collector member. A tubular shaft controls the forward resistance section and is rotatably supported within a bore of a mounting bushing. An inner shaft controls the rearward variable resistance section and a switch and is rotatably supported within the tubular shaft. The bore of the mounting bushing, the outside diameter of the tubular shaft, the bore of the tubular shaft, and the inner shaft are each provided with a narrowing diameter shoulder in abutting engagement with the proximate one of the shoulders for preventing impact damage to the resistance assemblies from external forces axially applied to the shafts. One of the collector members is provided with at least one radially elongated depression and a contacting protrusion is disposed on the corresponding contactor member so that when the contactor protrusion engages the collector depression a tactile sensation is transmitted to the corresponding shaft.

29 Claims, 9 Drawing Figures

TANDEM ELECTRICAL CONTROL

BACKGROUND OF THE INVENTION

1. Field of the Invention

The present invention relates to a tandem electrical control and, more particularly, to a pair of controls connected in tandem with concentric shafts.

In such tandem controls, the rotatable contactor assembly of the unit closest to the panel is usually driven by a tubular shaft or sleeve, while the other unit is independently driven by a solid shaft disposed inside and projecting from the tubular shaft. There are many instances when a switch secured to the rear unit is also driven by the solid shaft. The switch is actuated at some point of rotation of the solid shaft and often is used to turn on or off the apparatus in which the control has been installed.

2. Description of the Prior Art

A binding or seizing defect in the control is a common problem encountered by manufacturers and repairmen. It has been found that considerable damage occurs when one of the shafts is accidentally struck and the impact forces are transmitted to the corresponding variable resistance unit. In the past, various means have been devised for eliminating impact damage. U.S. Pat. No. 3,389,364, of common assignee, describes the use of a "C" washer on a single shaft control. U.S. Pat. No. 3,747,043, also of common assignee, describes a "C" washer engaging a groove in the wall of the outer tubular shaft and a groove in the inner shaft, and abuttingly engaging the distal end of a bushing to transfer to the bushing impact forces applied to either shaft. It has been found that the "C" washer construction is not entirely satisfactory. The "C" washer is easily deformable and presents a small area of engagement with the bushing and with the grooves of each of the shafts. A small deformation of the "C" washer can destroy the feel of the control thereby making the control unusable even though not binding. Additionally, if a switch is used on the control, a small deformation of the "C" washer can make the switch nonfunctional. If the strength of the "C" washer is increased, as by increasing the thickness or hardness of the material, then upon impact of the shaft, the shaft can be deformed and driven into the "C" washer because of the small bearing area between the shaft and the "C" washer and the high pressures thereby generated.

The functional equivalent of a "C" washer may be formed by an abrupt shoulder integrally provided on the shaft in abutting engagement with the distal end of the bushing. The integral shoulder is a distinct improvement over the "C" washer construction but suffers from the same aforementioned difficulty; namely, that of a small bearing area between the shoulder and the bushing. Additionally, a shaft with an abrupt or 90° shoulder is not self-centering within the outer member. If the shaft is disposed in an off-centered manner when the control sustains axial impact forces to the shaft, any deformation of the shaft or of the impact protection bearing surfaces caused by such forces, will be off-centered or nonconcentric with respect to the shaft axis. The off-center deformation may sufficiently damage the feel of the control or force the shaft to be sufficiently permanently off-center so as to make the control nonfunctional. In a self-centering construction, impact damage will cause a concentric seating of the two members and maintain concentricity and feel. It is therefore desirable to provide a control wherein the shafts are impact protected and such impact construction is self-centering.

It is often desirable to enable the user to adjust the control to a preselected position by feel rather than by sight as with car radios where it is desirable to enable the user to set a tone control for approximately flat tonal response or to select preselected degrees of tonal boost or cut without requiring the driver to look away from the road. Another such situation may arise in an attenuator or volume control where the control setting is determined by a detent feel rather than by sight. In such detented situations, it is often desirable to permit the user to set the control at any intermediate position between detent settings thereby providing the user with a continuously variable control capable of being set intermediate the discrete digital or quantized detent settings. The prior art as exemplified by U.S. Pat. Nos. 2,632,830 and 3,832,671 does not permit such nondetent settings of the control.

Additionally, positional detents used in variable resistance controls are often provided by a protrusion in the rear portion of the housing axially engaging the driver with the driver being provided with a recess adapted to at least partially receive the housing protrusion. The driver rides up on the protrusion between detent positions causing axial movement of the corresponding control shaft. This axial movement of the control shaft changes the tracking pressure or contacting pressure of the contactor member thereby tending toward erratic resistance settings. In addition, if a knob is secured to the shaft in proximity to a mounting panel, the knob can be driven into abutting interference engagement with the mounting panel by such axial movement in the detent position thereby binding or hindering further rotation of the control.

In response to the demand for miniaturization, it is desirable that controls be made smaller. In the past, the collector ring or member in contact with the rotatable contactor member has been spaced apart from the resistance element by legs extending from the outer periphery of the ring, thereby causing the collector ring to be disposed inwardly from the legs toward the shaft, and thereby restricting the shaft diameter. As the controls are made smaller, it is necessary that the portion of the shaft internal to the control be made thinner thereby weakening the shaft; whereas it is desirable to maximize the shaft diameter inside the housing as a part of the total program of miniaturization, it is essential to maintain a suitable diameter of the shaft inside the control housing in order to maintain the strength of the shaft, particularly for plastic shafts.

A common problem encountered in controls is the deviation from an ideal tracking path due to parts tolerances and malformed parts. Such deviant or poor tracking can result in an uneven wiping pressure between the contactor member and the resistance element or the collector member, causing a bad feel to the control and an increase in electrical noise manifesting itself as a nonuniform statistical deviation from the desired smooth resistance change when the control shaft is rotated. In the extreme, the tracking error manifests itself in the contacting portions of the contactor member riding off or disconnecting from the resistance element on the collector member. It is therefore desirable to minimize tracking error effects.

SUMMARY OF THE INVENTION

Accordingly, it is an object of the present invention to provide a tandem electrical control having improved and self-centering impact protection. Another object of the present invention is to provide a tandem electrical control wherein a detent is provided to designate predetermined electrical settings and yet maintain the infinite setting capability of the control. An additional object of the present invention is to provide a tandem electrical control wherein the size of the shaft internal to the control is maximized. Another object of the present invention is to provide a tandem electrical control wherein there is no axial displacement of the shaft in the detent position relative to a nondetent position. Yet another object of the present invention is to provide a tandem electrical control wherein a detent is provided with a minimum of additional parts and labor. Yet an additional object of the present invention is to provide a tandem electrical control wherein the tubular shaft controlling the front section need not be secured to the corresponding driver, thereby facilitating assembly. A further object of the present invention is to provide a tandem electrical control wherein the inner shaft controlling the rear section and a switch is axially constrained by snap-fitting the inner shaft into the front driver, thereby facilitating assembly of the control. Yet another object of the present invention is to provide a tandem electrical control wherein the tubular and inner shafts have the same pull-out force. A further object of the present invention is to provide a tandem electrical control wherein the effect of tracking error between the contactor member and both the resistance element and the collector member is minimized. A further object of the present invention is to provide a tandem electrical control wherein the contact pressure between the contactor member and both the resistance element and the collector member is substantially constant and results in reduced noise characteristics as the control setting is changed.

Further objects and advantages of the present invention will become apparent as the following description proceeds, and the features of novelty characterizing the invention will be pointed out with particularity in the claims annexed to and forming a part of the specification.

Briefly, the present invention relates to a tandem electrical control wherein two variable resistance sections with inner and outer concentric shafts extend outwardly through and are rotatably supported by a bore in a mounting bushing. Each variable resistance section is provided with a nonconductive base carrying a resistance element and a ring-shaped collector member, and a driver carrying a contactor member in wiping engagement with the resistance element and the collector member. In the exemplary embodiment, narrowing bearing shoulders in the mounting bushing bore, the outer tubular shaft, and the inner shaft provide anti-impact protection against axially directed forces applied to the shafts. The outer tubular shaft is constrained to rotate with and to control the first driver. The inner shaft is axially constrained within the first driver and is constrained to rotate with and to control the second driver. Depressions in the collector ring in operative cooperation with contacting protrusions of the contactor member provide a detent position for the control, yet permit intermediate settings. The collector member is held in spaced relationship with the respective base by legs extending from the inside diameter of the collector member in proximity to both shafts which pass therethrough, thereby permitting maximizing the shaft diameters. Radial elongation of the detent depressions in a crown on the contacting portion of the collector member, in cooperation with radial elongation of contacting protrusion of the contactor member, permits greater tolerance variation of the control members.

For a better understanding of the present invention, reference may be had to the accompanying drawings wherein the same reference numerals have been applied to like parts and wherein:

DESCRIPTION OF THE PREFERRED EMBODIMENT

Figure 1:
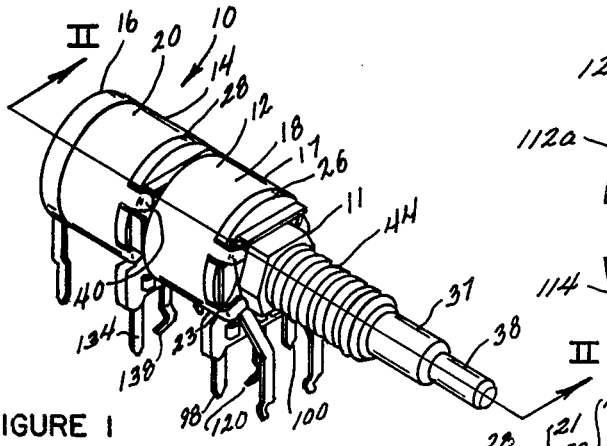
FIG. 1 is an isometric view of the control of the present invention.
Figure 2:
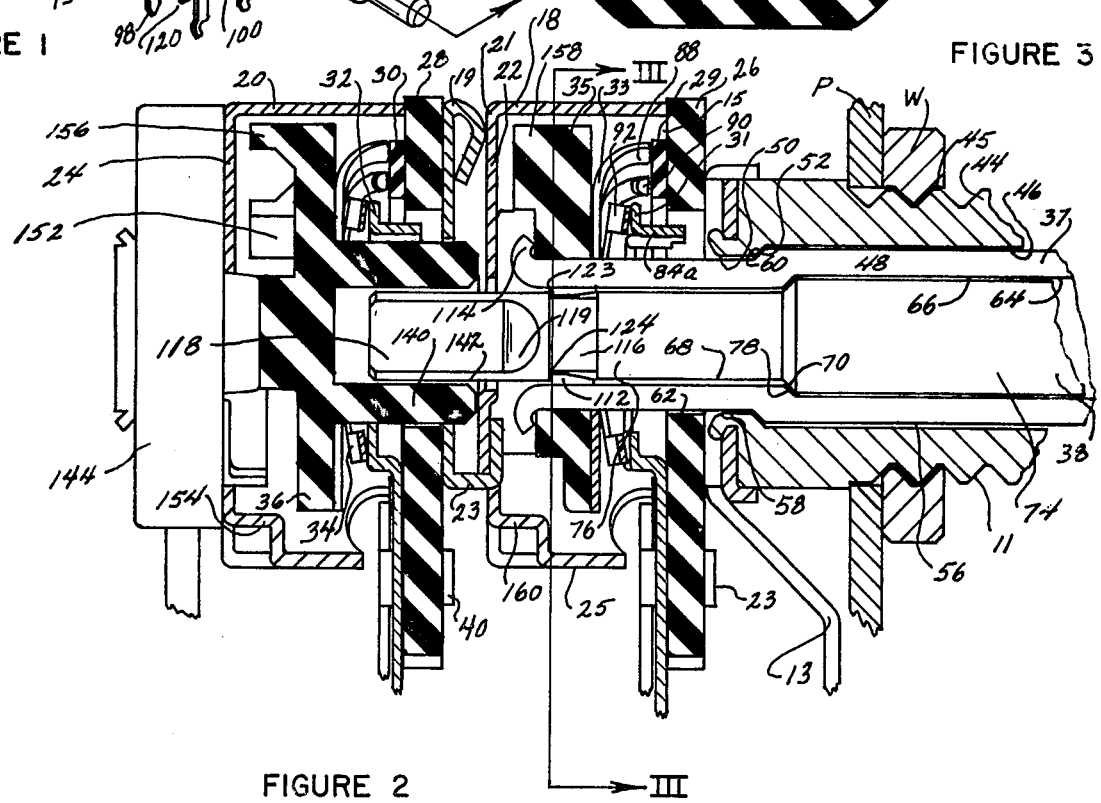
FIG. 2 is an elevated fragmentary sectional view, on an enlarged scale, taken generally along line II—II of FIG. 1 showing the control mounted to a panel.

Referring to FIGS. 1 and 2, the control of the present invention, generally designated 10, comprises a first or front resistance section 12, a second or rear resistance section 14, and a switch section 16. Each of the resistance sections 12 and 14 respectively comprise housings 18 and 20, mounting bases 26 and 28 being suported by the housings 18 and 20, elongated and arcuate resistance elements 29 and 30 and collector members 31 and 32 being carried by the bases 26 and 28, contactor members 33 and 34 being secured to drivers 35 and 36 which in turn are secured to rotatably supported shafts 37 and 38.

Referring again to FIGS. 1 and 2 but now only to the first or front resistance section 12, a shaft support and base unit 11 is provided which includes a threaded or shaft support bushing 44, a ground terminal plate 13, and the first or front mounting base 26. The shaft support and base unit 11 is secured to an open end 15 of the first or front housing 18 by a plurality of tabs 23, which are integral to a peripheral wall 25 of the housing 18 to form a housing assembly 17.

Referring again to FIGS. 1 and 2, the second or rear housing 20 is secured to the second or rear mounting base 28 and to an adapter bracket 19 by a plurality of tabs 40 which are integral to the housing 20. The adapter bracket 19 is secured to an opposite or apertured end portion 21 of the front housing 18 by a plurality of tabs 39 which are integral to the adapter bracket 19.

The bushing 44 is threaded along a peripheral surface 45 to accept a mounting nut "N" for securing the bushing 44 of the control 10 to a supporting member such as a panel "P".

Referring again to FIGS. 1 and 2 and to first or front resistance section 12, the bushing 44 includes a bore 46; and the bore 46 has an unreduced cylindrical bore portion 48, a reduced cylindrical bore portion 50, and a frustoconical shoulder 52 joining the portions 48 and 50. A tubular shaft 37 is disposed within the bore 46 and includes an unreduced diameter portion 56, a reduced diameter portion 58 and a frustoconical shoulder 60 which joins the portions 56 and 58 and which has a cone angle that matches the cone angle of the shoulder 52. One end of the tubular shaft 37 extends inwardly through an aperture 62 in the base 26 and the other end extends outwardly from the threaded bushing 44 to accept a knob or the like, (not shown). The paired portions 48 and 56 and the paired portions 50 and 58 are in close proximity to provide journalled support and yet to permit the tubular shaft 37 to rotate freely within the bore 46. As will be described in greater detail hereinafter, the frustoconical shoulders 52 and 60 are in rotatable abutting engagement thereby preventing inward axial movement of the tubular shaft 37 by the thrust bearing abutment of the shoulder 60 against the shoulder 52.

The tubular shaft 37 includes a bore 64 having an unreduced cylindrical bore portion 66, a reduced cylindrical bore portion 68 and a frustoconical shoulder 70 joining the portions 66 and 68. The inner shaft 38 is disposed within the bore 64; and the inner shaft 38 includes an unreduced diameter portion 74 which extends outwardly past the end of the tubular shaft 37, a reduced diameter portion 76 which extends inwardly through the tubular shaft 37, and a frustoconical shoulder 78 joining the portions 74 and 76 and having a cone angle that matches the shoulder 70.

The inner shaft 38 is rotatably supported within the bore 64 of the tubular shaft 37; and any inward axial forces applied to the inner shaft 38 will urge the shoulder 78 of inner shaft 38 to abuttingly engage, in a thrust bearing manner, against the inner shoulder 70 of tubular shaft 37 which in turn will urge the tubular shaft 37 inwardly and cause the shoulder 60 of tubular shaft 37 to abuttingly engage the shoulder 52 of the bushing 44, which in turn will urge the mounting bushing 44 against the mounting plate "P" thereby transferring the applied forces thereto.

An included angle of 90° for angle of the frustoconical shoulders 52, 60, 70, and 78 was chosen; however, the cone angle may be less to increase the bearing area. Decreasing the cone angle to less than 60° is not desirable as such a decreased angle would increase the tendency of the abutting portions to wedge.

In the embodiment herein described, the shafts 37 and 38 are prevented from moving inwardly and the axial forces applied to the shafts are transferred to the mounting bushing and the external mounting plate thereby protecting the inner variable resistance mechanisms from impact damage. The shafts 37 and 38 are each self-centering within the bores 46 and 64 by the frustoconical shoulders 52, 60, 70, and 78; therefore, the tracking of the contactor members 33 and 34 with the collector members 31 and 32 and with the resistance elements 29 and 30 will be maintained since the abutting shoulders 52 and 60, and 70 and 78 will concentrically seat even if impact damage or wear occurs.

The exemplary embodiment discloses a control with concentric shafts; however, it is within the contemplation of the present invention that the impact protection of the present invention may be utilized with a single shaft control.

Figure 4:
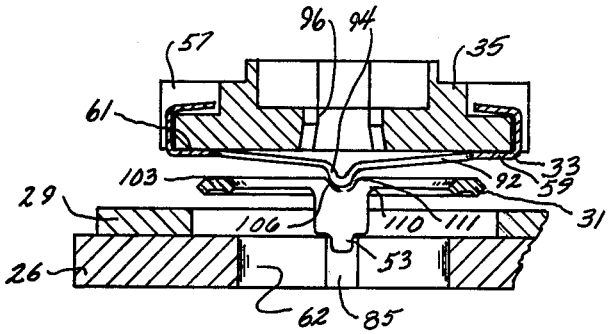
FIG. 4 is a fragmentary sectional view showing the engagement of the collector member and the contactor member in a detent position.
Figure 8:
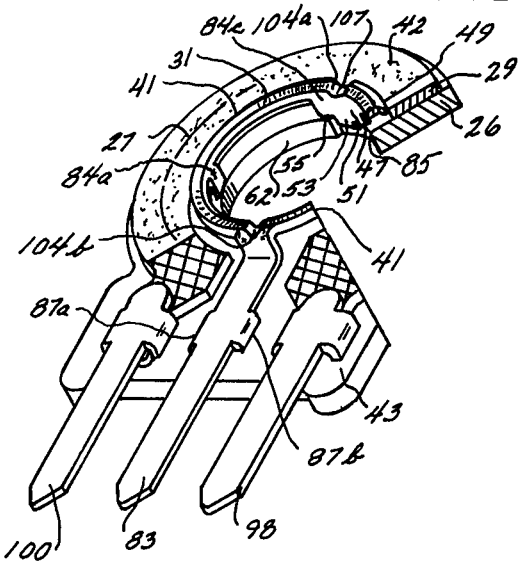
FIG. 8 is a fragmentary isometric view showing the mounting and the position of the collector member with respect to the base and the resistance element.

Referring now to FIGS. 4 and 8, the first arcuate resistance element 29 is disposed along a predetermined and arcuate path 27, includes a planar surface 42, is carried by a mounting face 43 of the base 26, and is concentric with the aperture 62. The resistance element 29 can be deposited on the base 26 or upon a sub-base (not shown) which in turn is secured in an appropriate manner to the mounting base 26.

The collector member 31, in the form of an annular ring 41, having inner and outer diameters 47 and 49 and having a radially extending terminal 83, is supported, proximal to the mounting face 43 of the mounting base 26 and concentrically with the resistance element 29, by a pair of spacer legs **84*a* and 84*b* extending orthogonally from the inner diameter 47 of the collector member 31 toward the base 26. A locator leg 51 extends orthogonally from the inner diameter 47 of the collector member 31 and includes both a locator tang 53 that engages a locator notch 85 opening into the aperture 62 of the base 26 and a spacer shoulder 55 that engages the mounting face 43 of the base 26**.

The collector member 31 is preferably secured to the base 26 by a pair of crimped legs **87*a* and 87*b* of the terminal 83; and the locator tang 53 cooperates with the crimped legs 87*a* and 87*b* to position the annular ring 41 concentrically with the first resistance element 29. The spacer shoulder 55 cooperates with the spacer legs 84*a* and 84*b* to engage the base 26 and thereby to maintain an axially spaced relationship between the collector member 31 and the resistance element 29 and to prevent lateral tilting of the collector member 31 as the contactor member 33** travels therearound.

The driver 35 includes a front face 54 and a rear face 57 and is rotatably supported within the housing 18 by the tubular shaft 37. The contactor member 33 includes a contacting surface 59 and a mounting surface 61 and is rotationally secured to the driver 35 with the mounting surface 61 of the contactor member proximal to the front face 54 of the driver 35.

Figure 9:
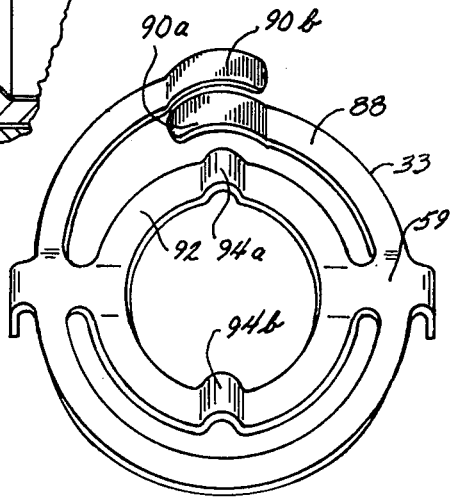
FIG. 9 is an isometric view of the contactor member.
Figure 7:
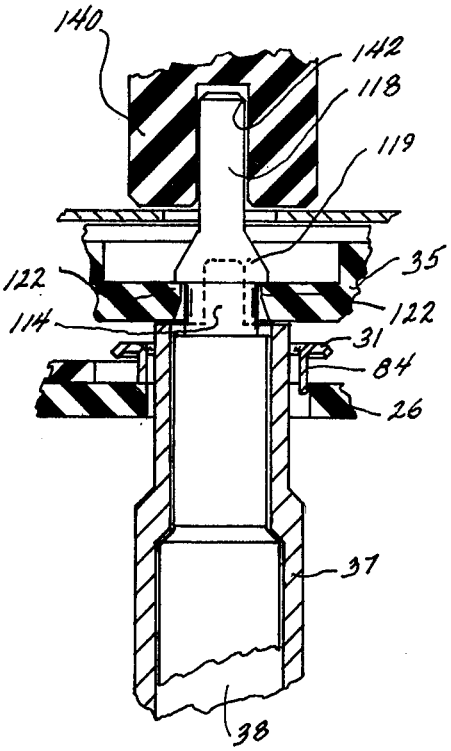
FIG. 7 is a fragmentary view of FIG. 6 rotated 90° showing the engagement of the inner shaft with the rear section driver.

Referring now to FIG. 9, the contactor member 33 is made of a spring-like material, preferably spring brass or the like, and is provided with an outer contactor portion 88 and an inner contactor portion 92 which are bowed outwardly to be spring-loaded against the resistance element 29 and the collector member 31, respectively. The outer contactor portion 88 is provided with first contactor means in the form of first and second radially disposed contact fingers **90*a* and 90*b* which are spring-loaded against the resistance element 29 thereby making electrical contact therewith. The inner contactor portion 92 is provided with a second contactor means in the form of a pair of protrusions 94*a* and 94*b* for making electrical contact with the collector member 31 and thereby completing an electrical connection between the resistance element 29 and the collector member 31**.

Referring now to FIGS. 2, 4, and 8, rotation of the contactor member 33 by the driver 35 and the tubular shaft 37 is effective to engage the arcuate resistance element 29 at selected positions along the arcuate path 27 and thereby to selectively determine the resistance between the terminal 83 and a pair of terminals 98 and 100 which are electrically connected to opposite ends of arcuate resistance element 29.

Figure 5:
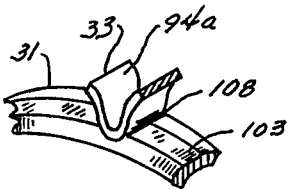
FIG. 5 is a fragmentary isometric view of the contactor protrusion in engagement with the detent depression of the collector member.

Referring now to FIGS. 4, 5, and 8, the control of the present invention is provided with a detent in the first resistance section 12, although a detent can be provided in any or all resistance sections. The annular ring 41 of the collector member 31 is in the form of a convexly curved crown 103 in cross-section, the crown having a blunted apex 105. The collector member 31 is also provided with a pair of detent depressions 104*a* and 104*b* that axially depend into diametrically opposite sides of the annular ring 41 and that are adapted to at least partially receive the contactor protrusions 94*a* and 94*b* of the contactor member 33. The detent depressions 104*a* and 104*b* are radially elongated and radially extend from the inner diameter 47 to the outer diameter 49 of the annular ring 41 with an apex 107 extending toward the first mounting base 26.

As the contactor protrusion 94*a* rides upon the crown 103 with rotation of the driver 35 and the shaft 37, the protrusion 94*a* approaches and engages the depression 104*a;* and as the protrusion 94*a* engages the depression 104*a,* the spring energy in the contactor member 33 urges the protrusion 94*a* along a first inclined surface 106 of the depression 104*a* resulting in a sudden decrease in the shaft torque required for the rotation of the contactor member 33. This sudden decrease in torque, and an increase in torque as the contactor protrusion 94*a* engages a second inclined surface 110 of the depression 104*a,* imparts a tactile sensation to the shaft through the contactor member 33 and the driver 35 thereby providing a detent.

Once the contactor protrusion 94*a* is nested within the depression 104*a,* it is then necessary that an increased torque be applied to the shaft 37 to rotate the contactor member 33 as the contactor protrusion 94*a* rides up the second inclined surface 110 of the depression 104*a,* working against the spring force of the contactor member 33. Once the contactor protrusion 94*a* has moved up the second inclined surface 110, partially compressing the contactor member 33, a second reduction of torque is encountered when the contactor protrusion 94*a* moves past the precipice 111. This second reduction of torque, in a manner similar to the first reduction of torque, imparts a tactile sensation to the shaft 37. In this manner, the variable resistance control of the present invention is therefore provided with a detent yet permitting nondiscrete settings of the control for resistance values intermediate the detent positions without additional parts and labor.

It is within the contemplation of the present invention that numerous depressions, not shown but similar to the depressions 104*a* and 104*b,* may be disposed at predetermined distances along the arcuate length of the annular ring 41 of the collector member 31 in order to provide a multiplicity of discrete detent positions yet still permitting intermediate settings of the control. The present embodiment includes a pair of depressions, 104*a* and 104*b,* being disposed 180° apart thereby providing simultaneous engagement of the protrusions 94*a* and 94*b* with respective ones of the depressions 104*a* and 104*b,* and thereby permitting the forces that are generated within the control to be symmetric and balanced about the coaxial center of the shaft 37. This symmetry, though desirable, is not necessary and a unitary protrusion 94 can be used. Additionally, a detent on a collector member of a rectilinear variable resistance control such as disclosed in U.S. Pat. No. 3,412,361, assigned to the same assignee as the present invention, permitting intermediate settings, is within the contemplation of the present invention.

Referring now to FIGS. 2 and 4, a further attribute of the present detent is that, as the contactor protrusion 94*a* engages and disengages the depression 104*a,* the contactor member 31 is decompressed and compressed without axial movement of the tubular shaft 37 and the driver 35, the axial movement of the shaft 37 being prevented by abutment of the frustoconical shoulders 52 and 60 as hereinbefore described and by the direction of the spring force of the contactor member 33. That is, the contactor member 33 and the resilient deformation thereof provides a first resilient bias force for contacting the resistance element 29 and a second resilient bias force for contacting the collector member 33. Both of these bias forces are directed rearwardly against the driver 35 so that they both serve to maintain the shoulders 52 and 60 in abutting engagement. The second bias force additionally serves to engage the protrusions 94*a* and 94*b* with the depressions 104*a* and 104*b.* The magnitude of this second bias force is decreased and increased as the protrusions 94*a* and 94*b* engage and disengage the depressions 104*a* and 104*b;* but the direction of this second bias force always serves to maintain the shoulders 52 and 60 in abutting engagement so that the contacting force of the fingers 90*a* and 90*b* against the resistance element 29 is not changed by the detent action. In addition, when a knob (not shown) is secured to the shaft 37 with a set screw (not shown) or the like, there is no axial movement of the shaft in the detent position to force the knob against the mounting panel and thereby to bind or interfere with the functioning of the control.

The detent of the present invention is preferably a soft detent. That is, the slope of inclined surfaces 106 and 110 and the second resilient bias force of the contactor member 33 do not produce a rotational torque that is sufficient to overcome the frictional resistance to rotation that is inherent in a control of this type. Thus it is possible to selectively position the tubular shaft 37 even within those rotary positions thereof that correspond to the engaging and disengaging of protrusions 94*a* and 94*b* with depressions 104*a* and 104*b.*

The present construction permits greater tolerance in the forming and construction of the contacting parts. Referring to FIGS. 4 and 5, the depressions 104*a* and 104*b* are radially elongated so that concentricity between the depressions 104*a* and 104*b* and the protrusions 94*a* and 94*b* is not critical. In addition, the protrusions 94*a* and 94*b* are preferably radially elongated, as shown, so that the contact between the protrusions 94*a* and 94*b* and the depressions 104*a* and 104*b* becomes a series of lines rather than a series of points, and thereby the wear life of the detent is substantially enhanced.

Figure 3:
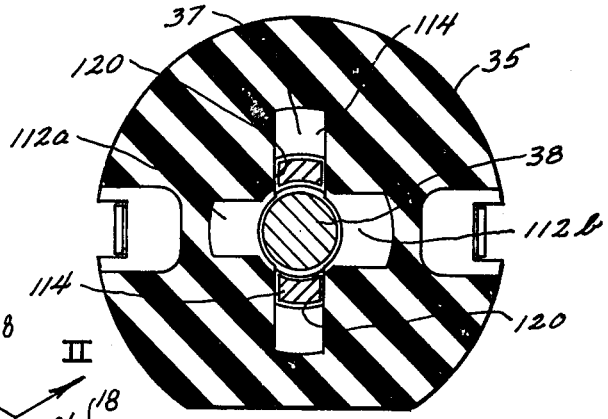
FIG. 3 is a fragmentary sectional view taken generally along line III—III of FIG. 2 showing the shaft engagement with the front section driver.

Referring to FIGS. 2, 3, 6, and 7, the reduced diameter portion 58 of the tubular shaft 37 and the reduced diameter portin 76 of the inner shaft 38 are each constrained within the aperture 96 of the driver 35. The reduced diameter portion 58 of the tubular shaft 37 is provided with notch means which comprisses a pair of diametrically opposite and axiallly extending tangs 114. The reduced diameter portion 76 of the inner shaft 38 is provided with an annular or circumferential groove 116, a flatted end portion 118 and a tapering portion 119. The aperture 96 as shown in FIG. 3 is provided with a pair of longitudinally disposed and diametrically opposite keyways 120 that are adapted to accept the tangs 114 of the tubular shaft 37. The driver 35 is composed of an appropriate material having cold flow resilient qualities such as nylon; and resilient abutments 112*a* and 112*b* are adapted to flexibly engage the groove 116 when the inner end of the shaft 38 is inserted therethrough.

In assembly, the tubular shaft 37 is first inserted through the threaded bushing 44 and into the driver 35 with the tangs 114 extending through the keyways 120, the shoulder 60 of the tubular shaft 37 being positioned in abutting engagement with the shoulder 52 of the threaded bushing 44. The inner shaft 38 is then inserted into the bore 64 of the tubular shaft 37 and into the aperture 96 of the driver 35. The abutments 112*a* and 112*b* are resiliently deformed by the tapering portion 119 to spread the abutments rearwardly and outwardly. A trailing edge 123 of each of the abutments, 112*a* and 112*b*, then resiliently engages a leading shoulder 124 of the groove 116 in a snap-action manner. Once in position, the shoulder 78 of inner shaft 38 abuttingly engages the shoulder 70 of the tubular shaft 37.

Figure 6:
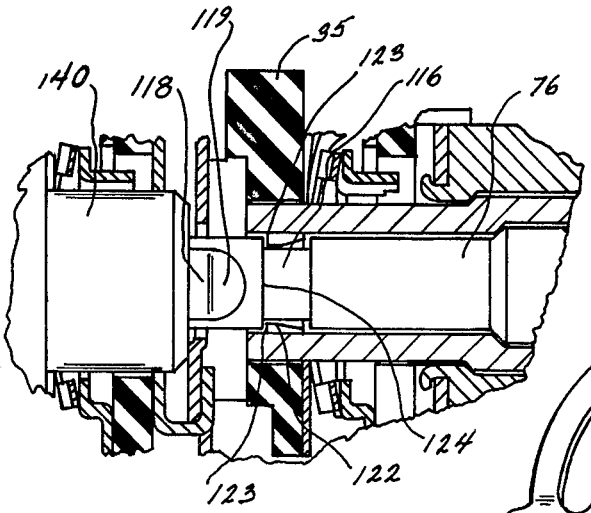
FIG. 6 is a fragmentary sectional view of FIG. 2 showing an alternate embodiment with the outer tubular shaft not secured to the front section driver.

Thus inner shaft 38 is retained within the bore 46 of tubular shaft 37, is prevented from moving axially inwardly by the shoulder 78 of the inner shaft 38 abutting against the shoulder 70 of the tubular shaft 37 and by the abutting of the shoulder 60 of the tubular shaft 37 against the shoulder 52 of the threaded bushing 44, and is prevented from moving axially outwardly by the training edges 123 of the abutments 112 engaging the leading shoulder 124 of the annular groove 116. The inner shaft 38 being so retained, in turn, retains the tubular shaft 37 in place. The tubular shaft 37 is prevented from axial outward movement by the shoulder 78 of the inner shaft 38 abuttingly engaging the shoulder 70 of the tubular shaft 37, thereby making the normally accepted practice of staking or otherwise securing the shaft 37 to the driver 35 unnecessary. This alternate embodiment is shown in FIG. 6.

The tangs 114 in the keyways 120 permit the tubular shaft 37 to rotatably move the driver 35, and the contactor member 33 that is secured thereto, at the urging of an external rotational force applied to the shaft 37. The shaft 38, although being locked against axial movement by the engagement of abutments 122 of the driving aperture 96 with the circumferential groove 116, is not prevented from rotating independently of the driver 35. Thus the shaft controlling the rear section is axially retained by members in the front section; and it is not necessary to retain the shaft controlling the front section by members in the front section. This structure permits the manufacturer the option of whether or not to secure the inward end of the shaft 37 to the driver 35.

If the tubular shaft 37 is secured to the driver 35 by staking as is represented in FIG. 1 by deforming radially outward a portion of the tangs 114, by "C" washer, or by other means, then it is necessary to assemble the control from the bushing or mounting end and proceed toward the rear. If the shaft 37 is not secured to the driver 35 but is merely constrained to rotate therewith by the tangs 114, then the control may be assembled starting at the rear portion and proceeding to the front mounting bushing as is the normal procedure, with the final assembly being the insertion of the tubular shaft 37 into the bore 46 with the tangs 114 matingly sliding into the keyways 120, and the inner shaft 38 then being inserted into the bore 46 and snap-fitted into position by the engagement of abutments 122 of the aperture 96 with the circumferential groove 116.

The flatted end portion 118 extends through an appropriate aperture in the apertured end portion 21 of the housing 18 of the front resistance section 12 and into the second resistance section 14. In a similar manner, the second resistance element 30 and the second collector member 32 is carried by a mounting face of the mounting base 28, and the second driver 36, with the second contactor member 34 rotationally secured thereto, is constrained to rotatably and to wipingly engage the resistance element 30 and the collector member 32. The ends of the second resistance element are connected to the terminals 134 and to another terminal (not shown, similar to terminal 134) and the collector member 32 is connected to a terminal 138. The driver 36 is provided with a forwardly extending shoulder 140 having a flatted bore 142 for receiving the flatted end portion 118 of the inner shaft 38 and is thereby constrained to rotate therewith. Rotational forces applied to the inner shaft 38 will cause the driver 36 and the contactor member 32 to rotate and change the electrical resistance setting of the second resistance section 14.

Referring again to FIG. 2, the switch section 16 comprises a nonconductive housing 144 supporting a stationary terminal (not shown) and a resilient movable terminal (not shown). The rear surface of the second driver 36 is provided with a camming protrusion 152 which is disposed in an interference path with the switch contacts to urge the switch contacts into and out of operative engagement upon rotation of the driver 36. The rear section driver 36 includes a stop protrusion 156; and a stop protrusion 154 in the housing 20 limits the rotation of a stop protrusion 156 of the rear section driver 36 in order to limit movement of the contactor member 34 within the arcuate limits of the resistance element 30. In a similar manner, a stop protrusion 158 of the driver 35 is disposed in an interference path with a stop protrusion 160 in the housing 18 to limit the movement of the contactor member 33 to within the arcuate limits of the resistance element 29.

While there has been illustrated and described what at present is considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed as new and desired to be secured by Letters Patent of the U.S. is:

1. An electrical control which comprises a shaft support and base unit having a mounting face, having an end distal from said mounting face, having a first unreduced cylindrical bore portion that intercepts said end and that extends orthogonally toward said mounting face, having a first reduced cylindrical bore portion that is smaller in diameter than said first cylindrical bore portion and that coaxially extends from said first unreduced cylindrical bore portion through said mounting face, and having a first shoulder that is concentrically disposed intermediate of said first unreduced and first reduced cylindrical bore portions;

a shaft having a first unreduced diameter portion that is rotatably and supportively carried in said first unreduced cylindrical bore portion, having a first reduced diameter portion that is rotatably and supportively carried in said first reduced cylindrical bore portion and that extends through said mounting face, and having a second shoulder that is concentrically disposed intermediate of said first reduced and first unreduced diameter portions and that rotatably engages said first shoulder to limit axial movement of said shaft in a first direction;

a driver having front and rear faces, having a driving aperture orthogonally intercepting said front face, being assembled onto said first reduced diameter portion with said front face proximal to said mounting face, and being drivingly secured to said first reduced diameter portion;

means for defining an elongated resistance element along an arcuate path on said mounting face that is substantially concentric with said second cylindrical bore portion;

an arcuate collector member having contacting and back surfaces, being interposed between said unit and said driver, being disposed substantially concentrically inside said arcuate resistance element, and being attached to said unit with said back surface proximal to said mounting face;

a contactor member having contacting and mounting surfaces, being drivingly secured to said driver with said mounting surface proximal to said front face thereof, including first contactor means for wipingly contacting said arcuate resistance element, and including second contactor means for wipingly contacting said collector member;

terminal means, being connected to said resistance element and to said collector member, for connecting said resistance element and said collector member to an electrical circuit; and means, including said driver, for limiting axial movement of said shaft in a second direction.

2. An electrical control as claimed in claim 1 in which said contactor member is made of metal having spring qualities and is formed to provide a fist resilient axial contacting force through said first contactor means and a second resilient axial contacting force through said second contactor means;

whereby said first and second resilient axial contacting forces are effective to resiliently urge said driver distal from said shaft supporting and base unit, and thereby to resiliently urge said first and second shoulders into axial engagement.

3. An electrical control as claimed in claim 2 in which one of said members includes a depression in said contacting surface thereof; and the other of said members includes a protrusion axially outward from said contacting surface thereof that is radially disposed to selectively register with said depression upon rotation of said shaft and said driver; whereby said second axial contacting force cooperates with said depression and with said protrusion to provide tactile driving torque change as said protrusion engages and disengages said depression.

4. An electrical control as claimed in claim 3 in which said one member comprises said collector member.

5. An electrical control as claimed in claim 3 in which said depression is radially elongated with respect to said arcuate path.

6. An electrical control as claimed in claim 5 in which said protrusion is radially elongated with respect to said arcuate path.

7. An electrical control as claimed in claim 3 in which said one member includes a second depression in said contacting surface thereof; and said other member includes a second protrusion from said contacting surface thereof that is disposed to register with said second depression when said first protrusion registers with said depression.

8. An electrical control as claimed in claim 7 in which said first and second depressions are spaced 180° apart around said arcuate path.

9. An electrical control as claimed in claim 2 in which said first contactor means comprises first and second radially disposed contact fingers.

10. An electrical control as claimed in claim 1 in which said shaft support and base unit comprises an external thread being proximal to said end thereof, and being coaxially disposed to said first unreduced cylindrical bore portion.

11. An electrical control as claimed in claim 1 in which both of said shoulders are frustoconical in shape with the frustums thereof distal from said end of said shaft supporting and base unit.

12. An electrical control as claimed in claim 1 in which said shaft support and base unit comprises a shaft support bushing having said first unreduced and first reduced cylindrical bore portions therein, and a base having said mounting face thereon and being secured to said shaft support bushing;

said base includes opening means therethrough for rotatably receiving said shaft, and a locator notch that opens into said mounting face; and said arcuate collector member comprises a circular ring having inside and outside diameters, having a pair of spacer legs that are circumferentially spaced from each other and that extend orthogonally from said inner diameter toward said base, and having a locator leg that is circumferentially spaced from said spacer legs and that extends orthogonally from said inner diameter and engages said locator notch.

13. An electrical control as claimed in claim 12 in which said locator leg includes a locator tang that makes said engagement with said locator notch, and a spacer shoulder that engages said mounting face of said base.

14. An electrical control as claimed in claim 1 in which said electrical control includes a housing having peripheral wall means for enclosing said driver, having an open end secured to said shaft support and base unit, having an opposite and apertured end portion that is distal from said shaft support and base unit and that is parallel to said mounting face thereof;

said shaft is tubular having a second unreduced cylindrical bore portion that is generally disposed within said first unreduced diameter portion and that is coaxial therewith, having a second reduced cylindrical bore portion that is smaller in diameter than said second unreduced cylindrical bore portion and that extends coaxially from said second unreduced cylindrical bore portion through said tubular shaft, and having a third shoulder that is concentrically disposed intermediate of said second unreduced and said second reduced cylindrical bore portions;

an inner shaft having a second unreduced diameter portion that is rotatably and supportively carried by said second unreduced cylindrical bore portion, having a second reduced diameter portion that is rotatably and supportively carried by said second reduced cylindrical bore portion and that extends through said driver, and having a fourth shoulder that is concentrically disposed intermediate of said second unreduced and second reduced diameter portions and that rotatably engages said third shoulder to limit said movement of said inner shaft in said first direction; and mans for limiting axial movement of said inner shaft in said second direction.

15. An electrical control as claimed in claim 14 in which said mans for limiting axial movement of said inner shaft in said second direction comprises means for axially retaining said inner shaft in said driver without restricting rotary motion therebetween; whereby said axial retaining of said inner shaft in said driver cooperates with said third and fourth shoulders to provide said means for limiting axial movement of said tubular shaft in said second direction.

16. An electrical control as claimed in claim 15 in which said driver is made of a resilient plastic material; and said means for axially retaining comprises an abutment in said driver, and a circumferential groove on said inner shaft.

17. An electrical control as claimed in claim 14 in which said tubular shaft includes notch means, in said first reduced diameter portion, for providing said drivingly securing of said driver to said tubular shaft; and said aperture in said driver includes means for torsionally engaging said notch means, and for providing said drivingly securing of said driver to said first reduced diameter portion of said tubular shaft.

18. An electrical control as claimed in claim 17 in which said notch means forms a pair of diametrically opposite and longitudinally extending tangs on said first reduced diameter portion that are distal from said second shoulder; and said torsional engaging means comprises a pair of longitudinally disposed and diametrically opposite keyways in said driver.

19. An electrical control as claimed in claim 14 in which said means for limiting axial movement of said tubular shaft in said second direction comprises deforming said first reduced diameter portion radially outward into axial retaining engagement with said driver.

20. An electrical control which comprises an elongated resistance element being disposed along a predetermined path;

a collector member;

a selectively positonable driver;

contactor member means, carried by said driver, for wipingly contacting said resistance element along said predetermined path, and for wipingly contacting said collector member;

means for moving and selectively positioning said driver; and detent means for providing a tactile change in positioning force as said contactor member means wipingly contacts said resistance element along said predetermined path to a predetermined location therealong, said detent means comprising a depression disposed on one of the collector member and the contactor member means, and a protrusion on the other of the collector member and the contactor member means at least partly receivable in the depression.

21. The electrical control of claim 20, wherein said predetermined path is arcuate and the driver and the contactor member means are rotatable.

22. An electrical control which comprises an elongated resistance element being disposed along a predetermined path;

a collector member;

a selectively positionable driver;

contactor member means, being carried by said driver, for wipingly contacting said resistance element along said predetermined path, and for wipingly contacting said collector member;

a depression being disposed into one of said members;

a protrusion being formed on the other of said members and being disposed to selectively engage said depression as said contactor member means contacts said resistance element at a predetermined point along said predetermined path;

resilient means, comprising spring action of one of said members, for resiliently engaging said members; and means for moving and selectively positioning said driver; whereby selected resistance values may be achieved by selectively positioning said driver, and a tactile change in positioning force occurs as said protrusion engages and disengages said depression.

23. An electrical control as claimed in claim 22 in which said one member comprises said collector member.

24. A variable resistance control as claimed in claim 22 in which said depression is elongated transversely to said predetermined path; and said protrusion is elongated transversely to said predetermined path.

25. An electrical control as claimed in claim 22 in which said predetermined path is arcuate.

26. In an electrical control of the type that includes a housing having a base at one end thereof and an opposite and apertured end portion at the other end thereof, a planar and arcuate shaped resistance element fixedly secured to said base, a collector member disposed radially inward from said resistance element and fixedly secured to said base, a shaft inserted orthogonally through said base and journalled to rotate in said housing, a driver disposed in said housing and rotationally secured onto said shaft to rotate therewith, and a contactor member rotationally secured to said driver to rotate therewith and wipably contacting both said resistance element and said collector member, the improvement which comprises:

stop means comprising a shoulder for axially limiting the movement of said shaft inwardly toward said housing;

axial retaining means for axially retaining said driver on said shaft;

detent means, interposed between said base and said driver, and comprising an axially depending depression and an axially projecting protrusion that is selectively engageable with said depression, for providing tactile change in the rotational force of said shaft as said detent means is engaged and disengaged; and resilient bias means, comprising resilient deflection of said contactor member, and exerting a rearward resilient force on said driver, for resiliently urging said shaft inwardly toward said stop means, for resiliently urging said contactor member into said wipable contact with said resistance element, for resiliently urging said contactor member into said wipable contact of said collector member, and for resiliently urging said protrusion into said depression; whereby said shaft is resiliently maintained in contact with said stop means;

said shaft comprising an unreduced diameter portion, a reduced diameter portion that is smaller in diameter than said unreduced diameter portion, and a shoulder that is intermediate of said diameter portions.

27. In an electrical control of the type that includes first and second arcuate resistance elements, first and second collector members, first and second drivers, first and second contactor members being carried by respective ones of said drivers and wipingly engaging respective ones of both said arcuate resistance elements and said collector members, a tubular shaft rotatably engaging said first driver, an inner shaft being journalled inside said tubular shaft and extending through said first driver to rotatably engage said second driver, shaft support and base means for journalling said tubular shaft and for mounting both said first arcuate resistance element and said first collector member, second base means for mounting both said second arcuate resistance element and said second collector member, and means for securing said second base to said shaft support and base means, the improvements which comprises:

first stop means, including a cooperating portion of said shaft support and base means, for limiting axial movement of said tubular shaft inwardly toward said second base;

second stop means, including a cooperating portion of said tubular shaft, for limiting axial movement of said inner shaft inwardly toward said second base; and attaching means, comprising cooperating portions of said first driver, for axially retaining said inner shaft in said first driver, and for limiting axial movement of said inner shaft outwardly away from said second base; whereby said attaching means and said second stop means cooperate to limit axial movement of said tubular shaft outwardly.

28. An electrical control as claimed in claim 27 in which one of said shafts includes an unreduced diameter portion, a reduced diameter portion that is smaller in diameter than said unreduced diameter portion, and a shoulder intermediate of said diameter portions; and one of said stop means comprises said shoulder.

29. In an electrical control of the type that includes first and second arcuate resistance elements, first and second collector members, first and second drivers, first and second contactor members being carried by respective ones of said drivers and wipingly engaging respective ones of both said arcuate resistance elements and said collector members, a tubular shaft rotatably engaging said first driver, an inner shaft being journalled inside said tubular shaft and extending through said first driver to rotatably engage said second driver, shaft support and base means for journalling said tubular shaft and for mounting both said first arcuate resistance element and said first collector member, second base means for mounting both said second arcuate resistance element and said second collector member, and means for securing said second base to said shaft support and base means, the improvement which comprises:

said journalling of said tubular shaft comprises a first unreduced cylindrical bore portion in said shaft support and base means that is distal from said arcuate resistance element, a first reduced cylindrical bore portion in said shaft support and base means that is smaller in diameter than said first unreduced cylindrical bore portion and that extends concentrically inward from said first unreduced cylindrical bore portion, and a first shoulder being intermediate of said first unreduced and first reduced cylindrical bore portions;

said tubular shaft comprises a first unreduced diameter portion, a first reduced diameter portion, and a second shoulder that is intermediate of said first unreduced and first reduced diameter portions and that abuttingly engages said first shoulder;

said journalling of said inner shaft comprises a second unreduced cylindrical bore portion in said tubular shaft that is distal from said arcuate resistance element, a second reduced cylindrical bore portion in said tubular shaft that is smaller in diameter than said second unreduced cylindrical bore portion and that extends concentrically inward from said second unreduced cylindrical bore portion, and a third shoulder being intermediate of said second unreduced and second reduced cylindrical bore portions;

said inner shaft comprises a second unreduced diameter portion, a second reduced diameter portion, and a fourth shoulder that is intermediate of said second unreduced and second reduced diameter portions and that abuttingly engages said third shoulder; and means for maintaining said abutting engagement of said first and second shoulders and of said third and fourth shoulders.

* * * * *